US005442259A

United States Patent [19]

Lameris et al.

[11] Patent Number: 5,442,259

[45] Date of Patent: Aug. 15, 1995

[54] POWER SUPPLY FOR VACUUM FLUORESCENT DISPLAYS

[75] Inventors: Gary J. Lameris, Dayton; Daniel C. Rothfuss, Vandalia, both of Ohio

[73] Assignee: Premark FEG Corporation, Wilmington, Del.

[21] Appl. No.: 236,479

[22] Filed: May 2, 1994

[51] Int. Cl.[6] ..... G09G 3/10; H05B 41/00

[52] U.S. Cl. ..... 315/169.4; 315/169.3; 315/337; 315/168; 345/75

[58] Field of Search ..... 315/169.1, 169.4, 260, 315/97, 209 R, 105, 107, DIG. 1, DIG. 4, 287, 169.3, 167, 168, 349, DIG. 7, 291, 307, 334; 313/336, 346 R, 351; 345/75, 76, 77, 74

[56] References Cited

U.S. PATENT DOCUMENTS

| | | | |
|---|---|---|---|
| 4,158,794 | 6/1979 | Sandler | 315/169.1 |
| 4,212,157 | 7/1980 | Frey | 368/87 |
| 4,495,445 | 1/1985 | Turney | 315/169.1 |
| 4,691,145 | 9/1987 | Satoh | 315/169.3 |
| 4,719,389 | 1/1988 | Miesterfeld | 315/169.1 |
| 4,973,882 | 11/1990 | Waugh | 315/105 |
| 5,001,399 | 3/1991 | Layden | 315/105 |
| 5,155,413 | 10/1992 | Bozzer et al. | 315/169.1 |

OTHER PUBLICATIONS

Oki Data Book "*Vacuum Fluorescent Driver*" Third Edition Issued Aug., 1992, pp. 279–291.

*Primary Examiner*—Ali Neyzari

*Attorney, Agent, or Firm*—Thompson, Hind and Flory

[57] ABSTRACT

A power supply for a large or dual vacuum fluorescent display having a DC source coupled to a switching regulator to generate a stepped up DC voltage. A −5 volt regulator is coupled to the switching regulator output, to provide a second DC voltage. A grid and segment driver is supplied with the regulator output. The driver is coupled to a microprocessor, and selectively drives the grid and plate segments to display data from the microprocessor. An oscillator circuit is also coupled to the DC source to generate an AC signal. The AC signal is coupled to an inverter to generate a second phase-shifted AC signal. The AC signals are provided to a pair of output drivers which amplify and output each signal to opposite ends of the filaments to heat the display filaments.

16 Claims, 5 Drawing Sheets

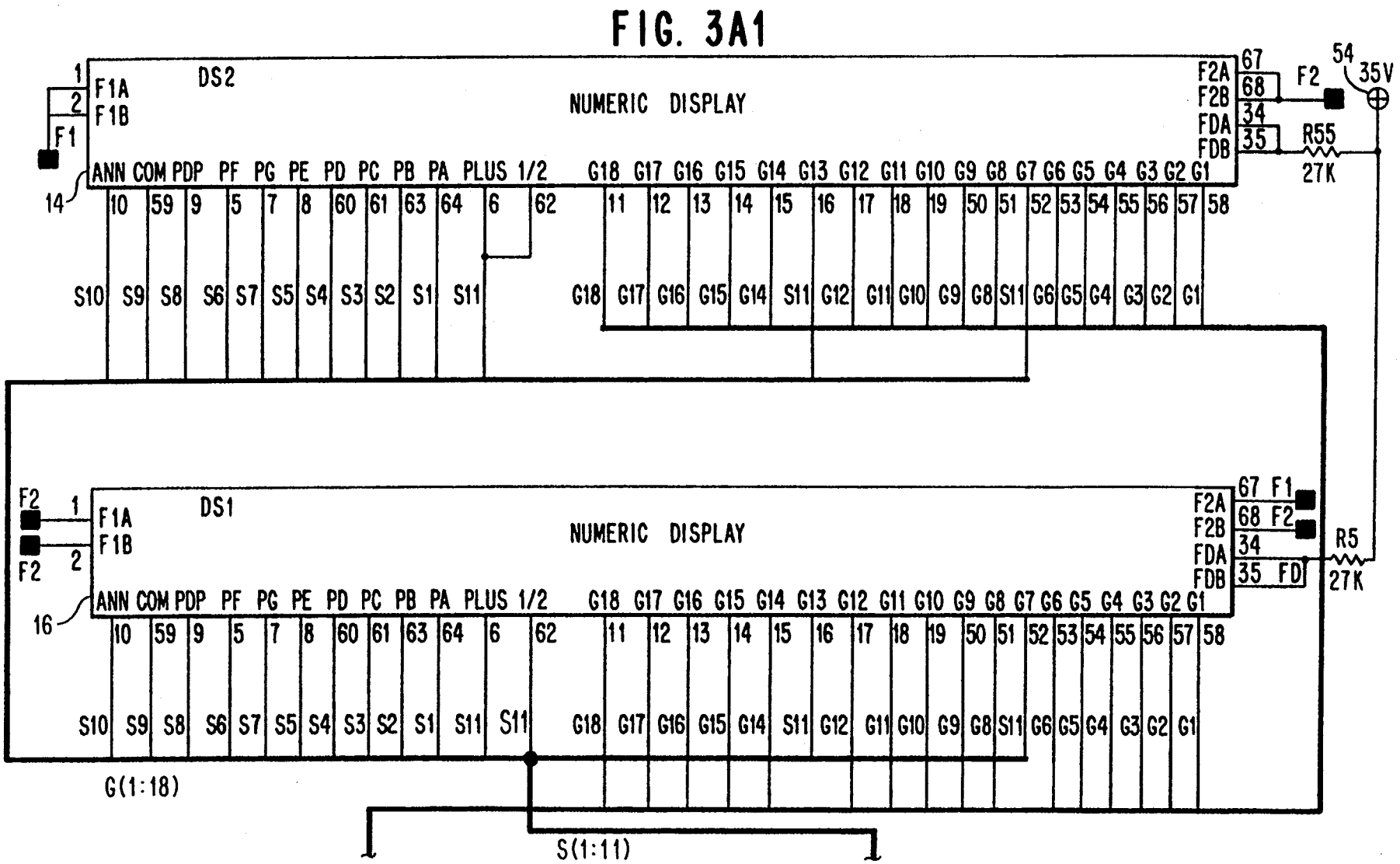
FIG. 3A1

FIG. 3A2
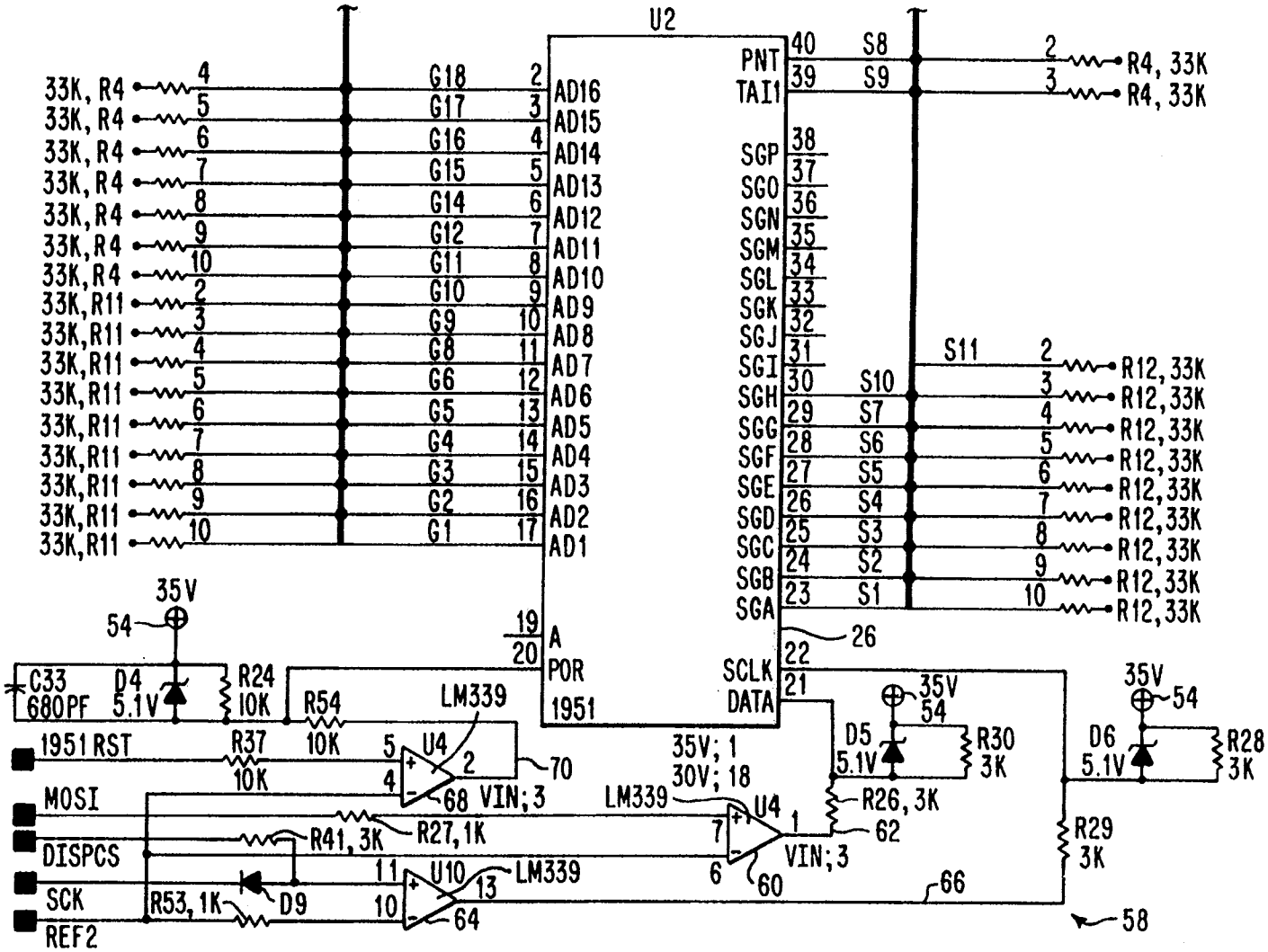

POWER SUPPLY FOR VACUUM FLUORESCENT DISPLAYS

BACKGROUND OF THE INVENTION

This invention relates to a power supply and driving circuit for a vacuum fluorescent display, and more particularly, to a power supply operable from a DC source for driving grid and plate segments, as well as heating filaments, in a large or dual vacuum fluorescent display.

Vacuum fluorescent displays are similar to vacuum tubes. A cathode, or filament/cathode combination, and a grid and plate are mounted in an evacuated glass envelope. The plate is coated with a phosphor. During operation, the heated filament emits electrons which, if accelerated by a positive potential on the grid, strike the phosphor on the plate, causing visible light photons to be emitted. The plate can be divided into a number of segments, which can be selectively charged with a positive potential to form a variety of alphanumeric characters.

Traditionally, the driving circuitry for a vacuum fluorescent display has been powered from an AC source, and has utilized either a transformer or a DC-DC/AC converter module to produce separate and stepped-up DC voltages for the grid and plate segments, as well as an AC signal for the display filament. However, the use of a transformer or converter module adds considerably to the cost and complexity of the display.

Due to the added cost and complexity associated with a transformer, display drive systems have been developed which are transformerless and operated from a D.C. source. However, these drive systems are low power/low voltage systems, such as would be utilized for a small digital clock, and are incapable of supplying sufficient power to meet the requirements of a large, dual display. Large, dual displays having in excess of 10 segments are utilized, for example, in weighing machines such as a produce scale. In order to meet the power requirements of these dual displays, a DC-DC converter must be used with the known transformerless power supplies, thereby adding significantly to the cost of the display.

Therefore, a need exists .for a power supply and drive system which can operate on a DC battery source, yet is compact, low-cost, and capable of generating sufficient power to drive a large or dual vacuum fluorescent display.

SUMMARY OF THE INVENTION

The present invention provides a transformerless power supply operable from a DC battery source for supplying an amplified, alternating current voltage to heat the filaments, and stepped-up DC voltages to drive the grids and plate segments in a dual vacuum fluorescent display.

The power supply of the present invention includes a DC power source, such as a battery, which supplies an unregulated DC signal of approximately 12 volts. A switching regulator is coupled to the DC source to provide a stepped-up regulated DC voltage. A −5 volt regulator is coupled to the switching regulator output pin to provide a second regulated DC voltage.

A grid and segment driver is supplied with the output voltages from the regulators, and is coupled to a microprocessor through a level translator circuit for receipt of display data. An oscillator circuit is also coupled to the DC source to produce an AC signal from the DC source signal. An inverter is coupled to the oscillator to produce a second, inverted AC signal from the oscillator signal. A first driver amplifier is coupled to the oscillator for amplifying the AC signal from the oscillator, and a second driver amplifier is coupled to the inverter for amplifying the inverted AC signal.

Output terminals from the amplifiers are connected to opposite ends of the display filaments to provide a constant, amplified AC current through the filaments to heat each of the filaments. Further, the output from each of the amplifiers is biased above the grid and plate segment off state voltages, thereby assuring proper operation of the display.

Accordingly, the present invention provides a power supply which is transformerless, yet produces sufficient power to drive a dual vacuum fluorescent display such as is used in a produce scale; a power supply which can be operated from a DC battery, thus enabling the device in which the display is installed, such as a produce scale, to be transported to a remote location, such as a farmer's market; and a power supply which is compact and can be implemented with low cost components.

Other objects and advantages of the present invention will be apparent from the following description, the accompanying drawings and the appended claims.

BRIEF DESCRIPTION OF THE DRAWINGS

FIG. 3 is a schematic of the dual displays, grid and plate driver, and level translator circuit portions of the power supply of FIG. 1.

DETAILED DESCRIPTION

Figure 1:
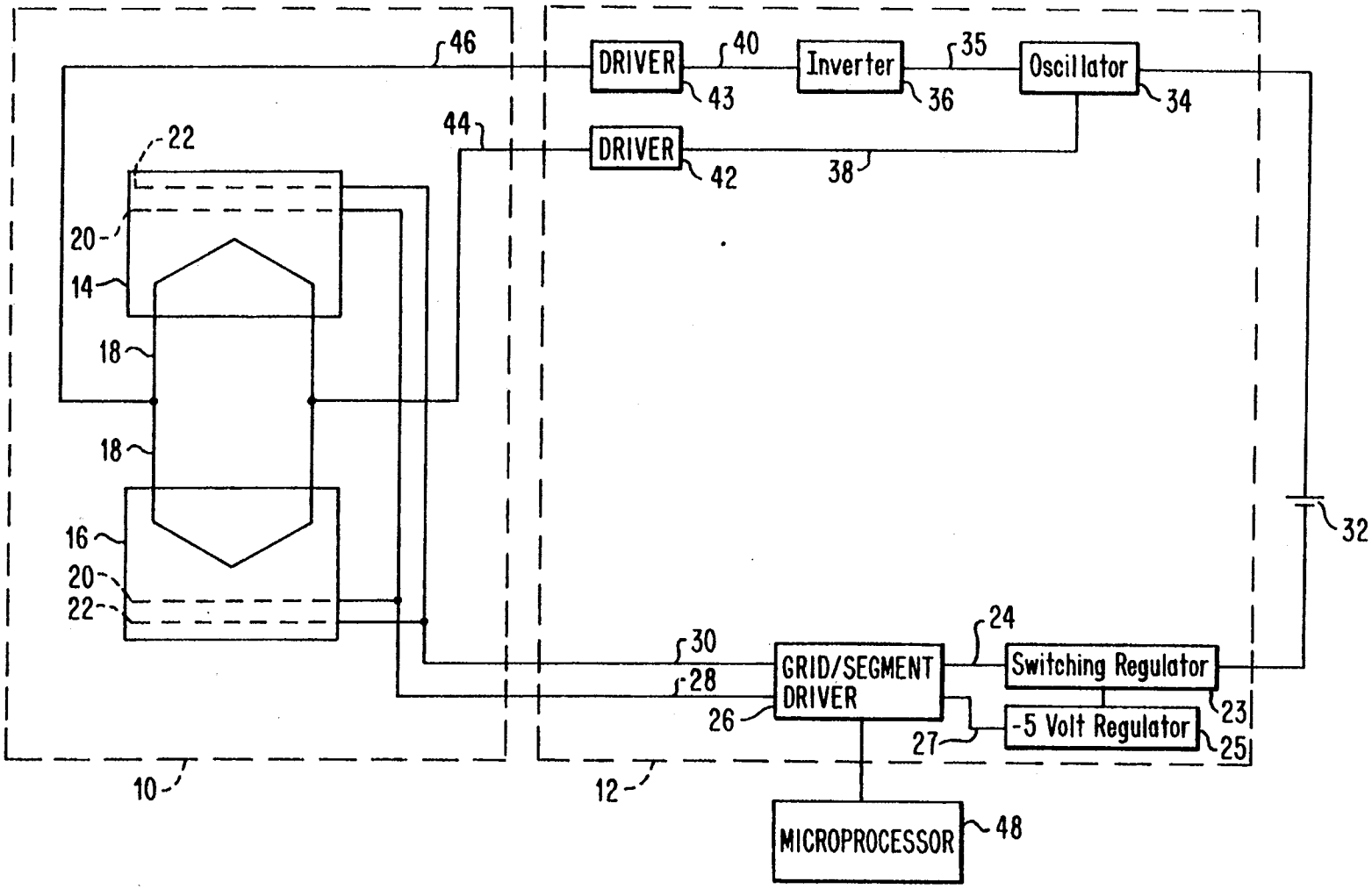
FIG. 1 is a block diagram of a vacuum fluorescent display system incorporating the power supply of the present invention.

FIG. 1 shows a block diagram of a dual vacuum fluorescent display system 10 which is driven by the power supply 12 of the present invention. The system 10 includes a pair of displays 14, 16, each having a cathode filament 18, a control grid 20 and plate segments 22. The power supply 12 includes a switching regulator 23 and a −5 volt regulator 25, which provide stepped-up DC power output on lines 24 and 27 to a grid and segment driver 26. The driver 26 provides voltage control signals on line 28 to the grids 20, and voltage control signals on line 30 to the plate segments 22, to control the operation of the display. For clarity, only a single line is shown for the grid signals, and a single line for the segment signals. However, it is to be understood that separate lines would be provided to each segment on the plates and each section on the grids. The power supply 12 is provided with its initial power from an external DC source 32, which can be a battery or any other DC source which is capable of producing approximately 12 volts DC.

The power supply 12 also includes an oscillator 34 which produces an AC signal from the DC source 32 signal. An inverter 36 is coupled to the oscillator 34 by line 35. The output signals from the oscillator 34 and the inverter 36 are provided along lines 38 and 40 to driver amplifiers 42 and 43. The amplifiers 42, 43 are connected along lines 44, 46 to opposite ends of the filaments 18, and provide an amplified, constant, alternating current through the filaments.

The data for the displays 14, 16 is provided to the driver 26 from a control device 48 which is, for example, a microprocessor. In a preferred embodiment, the power supply 12 is utilized in a dual display scale, such as would be used to weigh produce at a farmer's market. In this embodiment, the microprocessor 48 would supply the weight, unit price and cost data for the item being weighed to the grid and plate driver 26.

Figure 2:
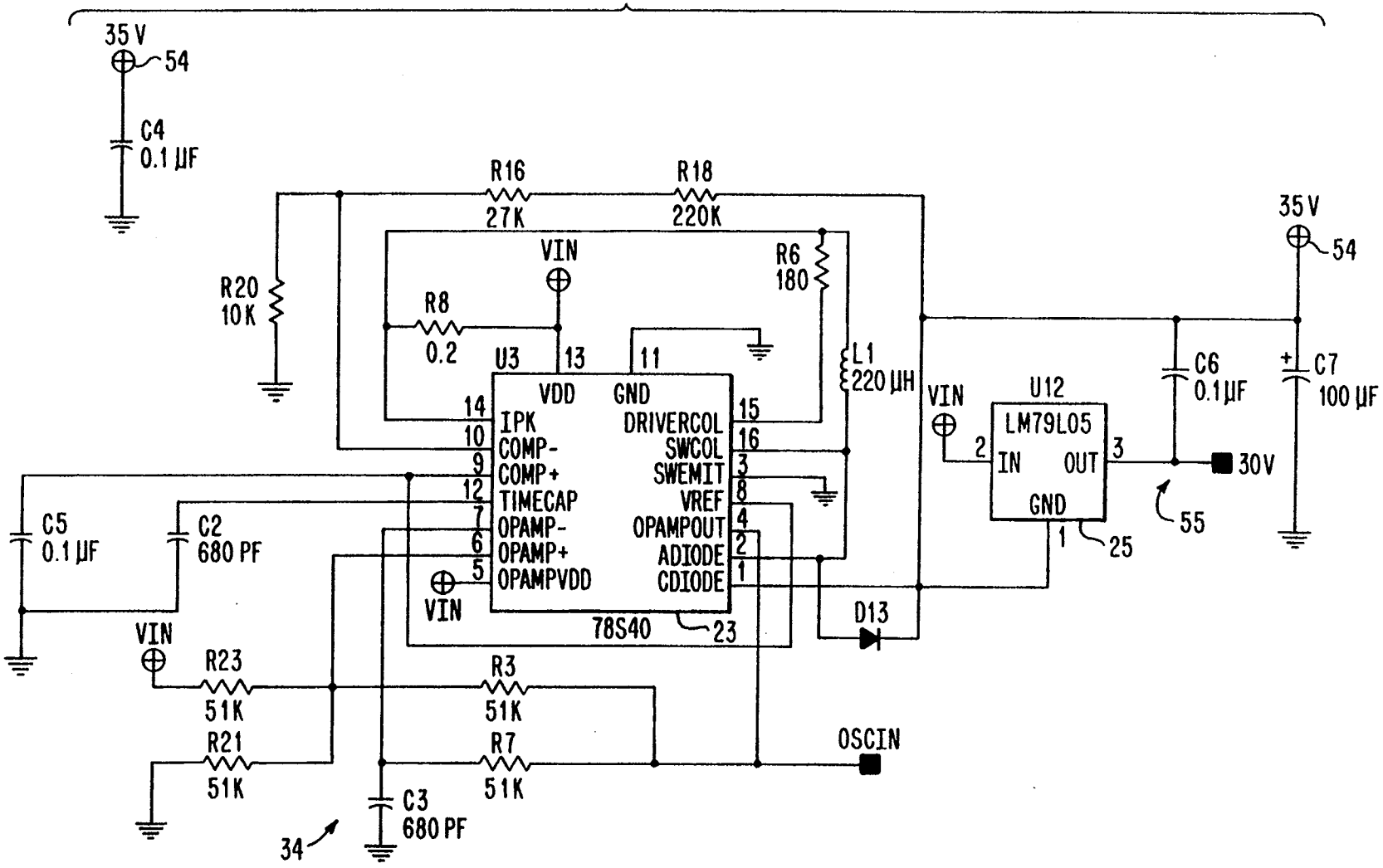
FIG. 2 is a schematic of the regulator and oscillator portions of the power supply of FIG. 1.

Referring now more particularly to FIG. 2, the power supply 12 of the present invention includes a voltage converter 23 connected to the DC source 32. In the preferred embodiment shown in the figures, the voltage converter 23 is a National Semiconductor Corporation LM78S40 Universal Switching Regulator which is configured in a conventional form for step-up operational performance. The switching regulator 23 and its operational characteristics are described in detail in National Semiconductor General Purpose Linear Devices Databook, 1989 Edition, at pages 2–86 to 2–91 inclusive, which is incorporated herein by reference.

In FIG. 2, the switching regulator 23 has pins 1–16 which correspond to the LM78S40 pins as represented in the databook. Pin 13 is connected to the DC source 32 for inputting the source voltage to the regulator 23, and pin 11 is connected to ground. External resistors R16, R18 and R20 are connected between pins 1 and 10, and ground, to form a voltage divider which in conjunction with the inductor L1 and components within the regulator 23 determines the voltage output at pin 1. In the preferred embodiment, inductor L1 and external resistors R16, R18 and R20 are selected so as to produce an output voltage at pin 1 of approximately 35 volts DC, for an input voltage of 12 volts DC. As shown in FIG. 2, in the preferred embodiment R16 has a value of 27 Kohm, R18 has a value of 220 Kohm, R20 has a value of 10 Kohm, and L1 has a value of 220 microhenries.

Pins 4–7 correspond to an uncommitted operational amplifier included in the LM78S40 switching regulator 23. In the preferred embodiment, this operational amplifier is utilized as part of the oscillator 34, as will be described in more detail below. The remaining pins on the switching regulator 23 are connected in the manufacturer's conventional form for step-up performance, as described in the databook.

Pin 1 is the power output for the switching regulator 23, which in the preferred embodiment outputs approximately 35 volts DC at 60 milliamps. The output of the switching regulator 23 is coupled to a voltage decreasing regulator 25, which produces a second DC voltage of lesser potential than the switching regulator output voltage. In the preferred embodiment, the voltage decreasing regulator is a National Semiconductor LM7905 −5 volt regulator which is described in the National Semiconductor General Purpose Linear Devices Databook, 1989 Edition, at pages 1–337 to 1–341 inclusive. However, it is to be understood that voltage regulators from other manufacturers may be utilized without departing from the scope of the invention. In the preferred embodiment, pin 1 of the switching regulator is coupled to the ground pin 1 of the −5 volt regulator 25 through diode D13. The in pin 2 of the −5 volt regulator 25 is coupled to the DC source 32 to power the regulator, and produce a voltage at the out pin 3 which is five volts below the voltage at pin 1 of the switching regulator 23. In this embodiment, the voltage output from the −5 volt regulator 25 is approximately 30 volts DC.

The output pins from the switching regulator 23 and the −5 volt regulator 25 are connected across an energy storing capacitor C6, which charges and discharges with the change in voltage from the switching regulator 23, to stabilize the operation of the −5 volt regulator 25. The output pin 1 of the switching regulator 23 is also coupled to an energy storing capacitor C7 in order to stabilize the regulator 23 output. Power is output from the switching regulator 23 through node 54, and from the −5 volt regulator 25 through node 55.

As shown in FIGS. 2 and 3, the output nodes 54, 55 from the switching regulator 23 and the −5 volt regulator 25 are coupled to the grid and plate driver 26 through a decoupling capacitor C4. In the preferred embodiment, the grid and plate driver 26 is an OKI MSC1951-01RS Vacuum Display Driver. This driver and its operating characteristics are described in detail in OKI Vacuum Fluorescent Driver Databook, 3rd Edition, at pages 279–291 inclusive, which is incorporated herein by reference.

In FIG. 3, the driver 26 has pins 1–40 corresponding to the MSC1951-01RS driver pins as described in the Databook. Pin 1 of the driver 26 is coupled to the switching regulator 23 output node 54, and pin 18 is coupled to the −5 volt regulator 25 output node 55. The difference between the voltages at pins 1 and 18 produces a 5 volt potential, which is required for operation of the driver 26. Driver 26 is configured to drive up to 16 grid segments in each of the displays 14, 16. Pins 2–17 on the driver 26 are each connected to a segment of the grid 20 and a 33 Kohm pull-down resistor network R11 and R4, which pulls the voltage through the segment to ground level when the segment is in an off state. Pins 23–30, 39 and 40 are connected to plate segments 22 for each of the displays 14, 16, and also to a 33 Kohm resistor R12 which pulls the plate segment voltage to ground level when the plate segment is in an off state.

Data from the microprocessor 48 (not shown in FIG. 3) is input to the driver 26 at pins 20–22. A level translator circuit, generally designated as 58, is provided between the microprocessor 48 and the driver 26 to adjust the signals from the 0 and 5 volt levels output from the microprocessor, to the approximately 30 and 35 volt levels utilized by the driver 26.

The level translator circuit 58 receives display data from the microprocessor 48 through a serial data line designated MOSI, and a clock signal through a clock line SCK. A data control line DISPCS and a voltage reference line REF2 also extend from the microprocessor to the level translator circuit 58 to control the data transmission to the driver 26.

Display data from the microprocessor 48 is input to the driver 26 through external resistors R26, R27 and comparator 60, along data signal line 62. Node 54 is coupled to the data signal line 62 to increase the signal potential to the driver 26 to at least 30 volts. The parallel combination of zener diode D5 and resistor R30 is connected between node 54 and the data signal line 62 to prevent the line voltage from dropping below 30 volts. Similarly, the clock signal is input to the driver 26 through diode D9, comparator 64, and resistor R29, along line 66. The voltage output at node 54 is input to the clock signal line 66 through the parallel combination of zener diode D6 and resistor R28, to increase the signal potential on line 66 to at least 30 volts.

Pin 20 of driver 26 is a power on reset which is coupled to the microprocessor 48 through line 1951RST, comparator 68 and external resistors R37, R54. The voltage at node 54 is input to the reset line 70 through the parallel combination of capacitor C33, zener diode D4 and resistor R24, to increase the potential of the reset line 70 to at least 30 volts.

The data signals, clock signals and power on reset signal are controlled by the microprocessor through voltage reference line REF2. Line REF2 provides a 2.5 volt reference voltage for switching the logic levels of the signals. Control line REF2 is connected to the inverting input terminals of the clock, data and reset comparators 60, 64 and 68, to control the input of data to the driver 26.

As described above, the LM78S40 switching regulator 23 includes an uncommitted operational amplifier at pins 4–7. As shown in FIG. 2, in the preferred embodiment this operational amplifier is connected through pins 4–7 to an external capacitor C3 and resistors R3, R7, R21 and R23 to form the oscillator 34. Capacitor C3 preferably has a value of 680 picofarads, to produce an AC signal having a frequency of 20–100 KHz. Although in the preferred embodiment the operational amplifier in the LM78S40 switching regulator 23 is utilized to form the oscillator 34, it is to be understood that an operational amplifier or comparator separate from the switching regulator 23 could be utilized to produce an AC signal, without departing from the scope of the invention.

Figure 4:
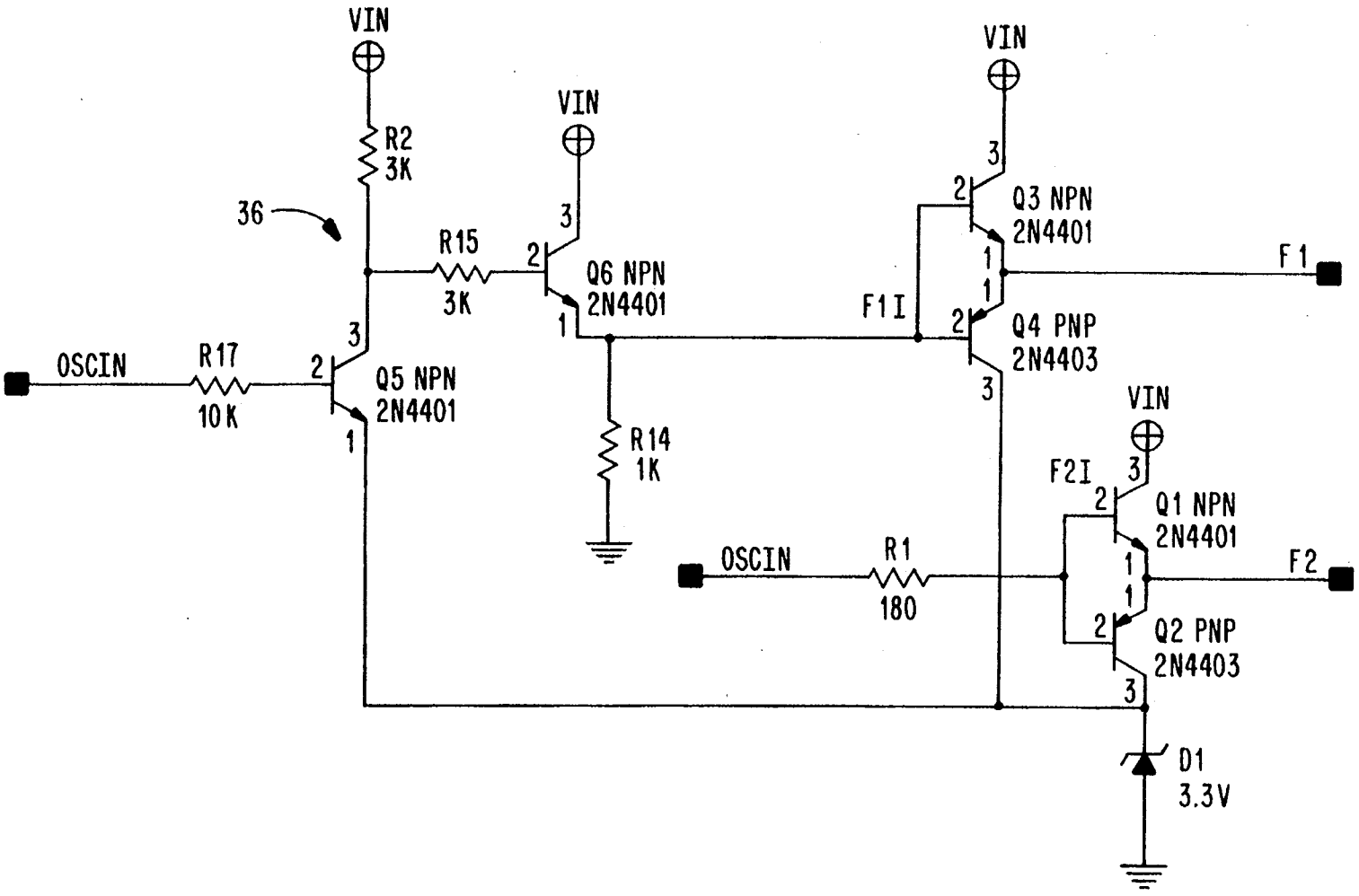
FIG. 4 is a schematic of the filament drive portion of the power supply of FIG. 1.

As shown in FIGS. 2 and 4, the output from the oscillator 34 is coupled to an inverting circuit generally designated as 36. The inverter 36 is comprised of an inverting transistor Q5 in a common collector arrangement, which is coupled to a low impedance common emitter amplifier Q6. The transistor Q5 produces a phase-shifted AC signal from the oscillator 34 output signal. The emitter terminal of transistor Q5 is coupled to a zener diode D1 to bias the transistor Q5 to a minimum of 1 volt, so that the transistor Q5 turns-off when the oscillator signal drops below the bias voltage.

The output from the inverter 36 is coupled to a filament drive amplifier F1I. Amplifier F1I consists of an NPN transistor Q3 and a PNP transistor Q4 connected in a complementary push-pull configuration. The base terminals of the transistors Q3 and Q4 are connected to the emitter terminal of transistor Q6 and the resistor R14. The collector of transistor Q3 is connected to the DC source 32, while the collector of transistor Q3 is connected in series with the zener diode D1. The zener diode D1 biases the output from the transistors Q3 and Q4 to a minimum voltage. In the preferred embodiment, diode D1 biases the transistor voltage to at least 3 volts. The emitter terminals of transistors Q3 and Q4 are connected to the amplifier output terminal F1. Terminal F1 is connected by line 46 to the first end of the filaments 18.

The output signal from the oscillator 34 is input to a second filament drive amplifier F2I comprised of transistors Q1 and Q2. Transistor Q1 is an NPN transistor which is connected in a complementary push-pull configuration with PNP transistor Q2. The base terminals of transistors Q1, Q2 are coupled to the oscillator 34 through resistor R1. The collector of transistor Q1 is coupled to the DC source 32, and the collector of transistor Q2 is coupled to zener diode D1, to bias the output voltage of the transistors to approximately 3 volts. The emitter terminals of transistors Q1 and Q2 are coupled to the amplifier output terminal F2. Terminal F2 is connected to the second end of the filaments 18 through line 44.

The operation of the preferred embodiment of the power supply 12 is as follows. When a 12 volt DC unregulated signal is provided to the power supply 12, the switching regulator 23 outputs a stepped-up 35 volt regulated DC signal at pin 1 and node 54. This stepped up voltage is input to the ground pin of the −5 volt regulator 25 to produce a 30 volt potential at node 55. The 30 and 35 volt DC signals are input to pins 1 and 18 respectively on the driver 26 to power the driver. The driver 26 then selectively drives the grid and plate segments 20, 22 on the displays in accordance with signals input from the microprocessor 48.

The DC source 32 is also coupled to the oscillator 34, which generates a 12 volt AC signal at 20–100 KHz. This AC signal is input to the inverter 36 to produce a second, phase-shifted AC signal. From the oscillator 34 and inverter 36, the AC signals are each input to one of the driver amplifiers F1I and F2I, to boost the power level of the signals prior to applying the signals to the ends of the filaments 18. The amplifiers F1I and F2I boost the AC signal power to approximately 250 mA, which provides a constant, alternating current of 125 mA in each of the filaments 18, and a voltage across the filament which varies between 3 and 12 volts. The zener diode biases the voltage across the filaments to vary between the zener diode cut-off of 3 volts, and the 12 volt peak voltage of the AC signal, so that the filament voltage is always at a higher potential than the grid and segment voltages.

While the circuit described constitutes a preferred embodiment of the invention, it is to be understood that the present invention is not limited to this precise form, and that variations may be made without departing from the scope of the invention.

What is claimed is:

1. A power supply for a vacuum fluorescent display of the type having a filament, a grid, and plate electrodes and operable from a DC voltage source, said supply comprising:

means for increasing a signal from said DC voltage source, said increasing means including switching regulator means connected to said DC voltage source for generating a first boosted DC signal, and means for supplying said first boosted DC signal to grid and segment drive means for said display;

oscillator means connected to said DC voltage source for producing a first AC signal from said DC voltage source signal;

means for inverting said first AC signal from said oscillator means to produce a second AC signal of opposite polarity; and means for amplifying said first and second AC signals and applying said amplified signals across said filament electrodes in said display to drive said filament.

2. The supply of claim 1 wherein said increasing means further comprises means for generating a second DC voltage signal-from said first DC signal, and means for supplying said first and second DC signals to said grid and segment drive means.

3. The supply of claim 2 wherein said generating means includes a −5 volt regulator means coupled to said switching regulator means for generating said second DC signal, said second DC signal being of a lower potential than said first DC signal.

4. The supply of claim 1 wherein said oscillator means includes an operational amplifier, capacitor means and resistor means, and wherein said operational amplifier is supplied by said DC source.

5. The supply of claim 4 wherein said operational amplifier is included in said switching regulator, and said capacitor means and said resistor means are coupled to said operational amplifier external to said regulator.

6. The supply of claim 5 wherein said oscillating means generates an AC signal having a frequency of between 20–100 KHz.

7. The supply of claim 4 wherein said inverting means includes transistor means.

8. The supply of claim 7 wherein said amplifying means includes a plurality of high-output current amplifiers.

9. The supply of claim 8 wherein said high-output current amplifiers are a pair of push-pull amplifier drivers and wherein one of said push-pull drivers is coupled to said oscillator means and one of said push-pull drivers is coupled to said inverting means.

10. The supply of claim 9 wherein said amplifying means further includes a voltage regulating means for biasing a voltage output to said filaments.

11. A transformerless power circuit for powering a grid and segment driver and heating filaments in a dual vacuum fluorescent display, said circuit comprising:

a source of a DC signal;

a switching regulator for stepping up said DC signal to produce a first boosted DC voltage;

a voltage-decreasing regulator coupled to said switching regulator for producing a second DC voltage of lesser potential than said first boosted DC voltage;

a grid and plate driver means coupled to said regulators, said driver means being powered by said regulators;

an oscillator means coupled to said DC source for producing a first AC signal;

an inverter means coupled to said oscillator means for producing a second AC signal of opposite polarity from said first AC signal;

a first current amplifier coupled to said oscillator for amplifying said first AC signal, said first current amplifier including a first transistor connected in a push-pull configuration with a second transistor;

a second current amplifier coupled to said inverter means for amplifying said second AC signal; and wherein said first and second current amplifiers are coupled to opposite ends of said filaments to drive said filaments.

12. The circuit of claim 11 further comprising means for biasing an output from said amplifiers.

13. The circuit of claim 12 wherein said biasing means is a zener diode.

14. The circuit of claim 13 wherein said oscillator means includes an operational amplifier, an external capacitor and a plurality of resistors.

15. The circuit of claim 14 wherein said first and second amplifiers are push-pull amplifiers.

16. The circuit of claim 15 wherein said inverter means includes an inverting transistor.

* * * * *